US011306573B2

(12) United States Patent
Webster

(10) Patent No.: US 11,306,573 B2
(45) Date of Patent: Apr. 19, 2022

(54) SINGLE STRAIGHT-LINE CONNECTION FOR HYDRAULIC FRACTURING FLOWBACK

(71) Applicant: SPM Oil & Gas PC LLC, Fort Worth, TX (US)

(72) Inventor: Matthew Thomas Robinson Webster, Alberta (CA)

(73) Assignee: SPM Oil & Gas PC LLC, Fort Worth, TX (US)

( * ) Notice: Subject to any disclaimer, the term of this patent is extended or adjusted under 35 U.S.C. 154(b) by 0 days.

(21) Appl. No.: 16/977,457

(22) PCT Filed: Mar. 1, 2019

(86) PCT No.: PCT/US2019/020280
§ 371 (c)(1),
(2) Date: Sep. 1, 2020

(87) PCT Pub. No.: WO2019/169261
PCT Pub. Date: Sep. 6, 2019

(65) Prior Publication Data

US 2020/0400003 A1 Dec. 24, 2020

Related U.S. Application Data

(60) Provisional application No. 62/637,506, filed on Mar. 2, 2018.

(51) Int. Cl.
*E21B 43/26* (2006.01)
*E21B 33/068* (2006.01)
*E21B 34/02* (2006.01)

(52) U.S. Cl.
CPC ..... *E21B 43/26* (2013.01); *E21B 33/068* (2013.01); *E21B 34/02* (2013.01)

(58) Field of Classification Search
CPC ..... E21B 43/26; E21B 33/068; E21B 34/02
See application file for complete search history.

(56) References Cited

U.S. PATENT DOCUMENTS 8,318,027 B2 11/2012 McGuire et al.
2010/0206560 A1* 8/2010 Atencio ..... E21B 43/12 166/250.15

(Continued)

OTHER PUBLICATIONS

International Search Report and Written Opinion received in Patent Cooperation Treaty Application No. PCT/US2019/020280, dated May 3, 2019.

*Primary Examiner* — Aaron L Lembo
(74) *Attorney, Agent, or Firm* — Wei Wei Jeang; Grable Martin Fulton PLLC

(57) ABSTRACT

A frac tree coupled to a wellhead is connected to either flowback equipment or zipper modules using a single straight-line connection of pipes, valves, and/or frac iron that define a straight-line pathway for fluid, gas, or flowback materials. The disclosed single straight-line connections referenced herein may be used in pressure pumping operations to deliver hydraulic fracturing fluid ("frack fluid") to a frac tree for delivery to a wellhead or for carrying flowback from the wellhead to a flowback-collecting equipment. Using the single straight-line connections referenced herein dramatically reduces the complexity of connections needed to deliver frack fluid to or carry flowback away from a well, thereby reducing the cost, improving the efficiency, and increasing the safety of pressure-pumping and flowback operations.

20 Claims, 12 Drawing Sheets

(56) References Cited

U.S. PATENT DOCUMENTS

| | | | | |
|---|---|---|---|---|
| 2011/0233143 | A1* | 9/2011 | McGuire | C02F 1/008 210/748.02 |
| 2012/0325751 | A1 | 12/2012 | Renick et al. | |
| 2013/0284455 | A1 | 10/2013 | Kajaria et al. | |
| 2017/0370172 | A1* | 12/2017 | Tran | F04B 23/04 |
| 2018/0058171 | A1* | 3/2018 | Roesner | E21B 33/068 |
| 2018/0202274 | A1* | 7/2018 | Montgomery | E21B 43/26 |
| 2018/0224044 | A1* | 8/2018 | Penney | F16L 41/03 |
| 2019/0010781 | A1* | 1/2019 | Tran | E21B 43/26 |

* cited by examiner

SINGLE STRAIGHT-LINE CONNECTION FOR HYDRAULIC FRACTURING FLOWBACK

RELATED APPLICATION

This application is a national phase application of Patent Cooperation Treaty Application No. PCT/US2019/020280 filed Mar. 1, 2019, which claims priority to U.S. Provisional Application No. 62/637,506 filed Mar. 2, 2018.

CROSS-REFERENCE TO RELATED APPLICATIONS

This application claims priority to and the benefit of U.S. Provisional Patent Application Ser. No. 62/637,506, filed on Mar. 2, 2018 and entitled "SINGLE STRAIGHT LINE FOR HYDRAULIC FRACTURING FLOWBACK," which is incorporated herein by reference in its entirety.

BACKGROUND

Oil and gas exploration requires complex industrial equipment to be interconnected at a well site in a precise manner. Typically, a drilling rig or well head is connected to a pump of some type to drive drilling and mining operations. A particular site may have numerous wells that are drilled. To improve production at these sites, fluids may be pumped down these well holes to fracture subterranean layers and thereby free oil and natural gas. This process is commonly referred to as "hydraulic fracturing" or simply "fracking." Hydraulic fracturing produces fractures in the rock formation that stimulate the flow of natural gas or oil, increasing the volumes that can be recovered. Fractures are created by pumping large quantities of fluids at high pressure down a wellbore and into the target rock formation.

Fracking requires specialized equipment to pump fluids, at varying pressures, to the holes. This is conventionally done by a "frac" pump supplying fluids ("frack fluids") to the well head for selective delivery down the well hole. Frack fluids are conveyed from frac pumps to wellheads using interconnected mechanical networks of piping, commonly referred to in the industry as "flow iron." In essence, the flow iron piping must provide flow paths for varying degrees of pressurized fracking fluids, such as sand, proppant, water, acids, or mixtures thereof. Fracking fluid commonly consists of water, proppant, and chemical additives that open and enlarge fractures within the rock formation. These fractures can extend several hundred feet away from the wellbore. The proppants—sand, ceramic pellets, acids, or other small incompressible particles—hold open the newly created fractures.

Once the injection process is completed, the internal pressure of the rock formation causes fluid to return to the surface through the wellbore. "Flowback" and "flowback fluids" refer to process fluids that are collected in oil and gas operations at the surface after hydraulic fracturing operations are completed. Flowback may contain both the hydraulic fracturing fluids used to frack a well as well as volatile hydrocarbons from the well itself. In fracking operations, flowback must be collected to avoid contamination and is typically stored on site in tanks or pits before treatment, disposal, or recycling. If not properly collected and disposed, the flowback may be dangerous for onsite workers and/or the environment. It is therefore crucial that a fracking operation have a safe and reliable flowback setup.

Connecting hydraulic pumps to wellheads and carrying flowback water from a site are complex operations. Frac pumps and flowback collectors are usually placed away from wellheads along outside terrain that is both subject to weather conditions and often at different non-uniform elevations. Also, frac iron typically needs to be rigid to convey the pressurized frack fluids, but the wellhead and frac pumps are usually at different elevations in undeveloped land. Maintaining tight, rigid connections between such complicated piping requires a substantial amount of set up time and can be difficult due to outside terrain varying in elevation.

SUMMARY

The examples and embodiment disclosed herein are described in detail below with reference to the accompanying drawings. The below Summary is provided to illustrate some examples disclosed herein, and is not meant to necessarily limit all systems, methods, or sequences of operation of the examples and embodiments disclosed herein.

Some aspects disclosed herein are directed to a single straight-line connection between a frac tree coupled to a wellhead and a flowback container. The flowback container includes a first end at an inlet port, and the frac tree includes a second end at an outlet port for dispelling flowback. More specifically, the single straight-line connection includes: one or more pipes and one or more valves. At least one end of the one or more pipes is connected to either the first end of the flowback container or the second end of the frac tree. And the connected one or more valves and the one or more pipes define a straight-line channel for the flowback, the straight-line channel defining a first axis at a constant height between the flowback container and the frac tree.

In some embodiments, the one or more valves comprise at least one of a gate valve or a plug valve.

In some embodiments, the one or more valves are positioned between at least two of the one or more pipes.

In some embodiments, the frac tree defines a second fluid channel for the flowback to flow from the wellhead, the second fluid channel having a second axis that is perpendicular to the first axis of the single straight-line connection.

In some embodiments, the one or more pipes and the one or more valves are connected to form a single conduit between the frac tree and the flowback container, and the single conduit is buttressed by a support between the frac tree and the flowback container.

Additionally, some embodiments include one or more pieces of frac iron connected to the one or more pipes and the one or more valves, the frac iron comprise at least one member of a group comprising: a swivel joint, pup joint, ball injector, crow's foot, air chamber, crossover, rigid hose, tee, wye, or lateral.

In some embodiments, an elbow connected to a top of the frac tree for defining a curved pathway to direct flowback from the frac tree to the straight-line channel. The elbow may define the curved path from a first end to a second end that faces 90 degrees away from the first end.

Additional aspects are directed to a system for directing flowback from a wellhead a frac tree coupled to a wellhead to a flowback container. The system includes one or more pipes, valves, or frac iron connected together along a straight line to form a first single straight-line connection between the frac tree and the flowback container, with the one or more pipes, valves, or frac iron defining a first internal channel for flowback that spans between the frac tree and the flowback container along only a single horizontal axis.

In some embodiments, the frac tree includes at one or more gate valves stacked vertically with a second internal channel defined therethrough for allowing flowback exiting the well to be directed to the first single-straight line connection.

Additionally, a zipper module may be connected to one or more manifolds for delivering frack fluid from one or more frac pumps, and a second single straight-line connection connected to the zipper module and the frac trac and defining a second internal channel for the frack fluid to be delivered to the frac tree for supply to the well.

In some embodiments, the flowback includes a mixture of natural gas and cuttings from the well.

In some embodiments, the flowback container includes an inlet port positioned on an upper side of the flowback container and a rounded body.

Additional aspects are directed to a flowback system for capturing flowback from a well affixed with a frac tree, with the frac tree defining a vertical internal channel for the flowback exiting the well and having an exit port for directing the well along a horizontal axis perpendicular to the vertical internal channel. The flowback system includes a flowback container with an inlet port and a single straight-line connection configured to be connected to the inlet port of the flowback container and the exit port of the frac tree. The single straight-line connection includes a connected arrangement of one or more pipes and at least one valve that together define a straight internal channel from the exit port of the frac tree to the inlet port of the flowback container for the flowback to be communicated to the flowback container.

In some embodiments, the one or more pipes comprise at least two pipes that are separated and connected to the at least one valve.

In some embodiments, the at least one valve comprises at least one of a gate valve or a plug valve.

In some embodiments, the at least one valve is electronically actuatable by a remote computing device.

In some embodiments, the single straight-line connection defines the straight internal channel to have a constant height from the frac tree to the flowback container.

In some embodiments, the single straight-line connection comprises has not bends or turns between the frac tree and the flowback container.

Other aspects, features, and advantages will become apparent from the following detailed description when taken in conjunction with the accompanying drawings, which are a part of this disclosure and which illustrate, by way of example, principles of the inventions disclosed.

BRIEF DESCRIPTION OF THE DRAWINGS

The accompanying drawings facilitate an understanding of the various embodiments disclosed herein.

DETAILED DESCRIPTION

Figure 1:
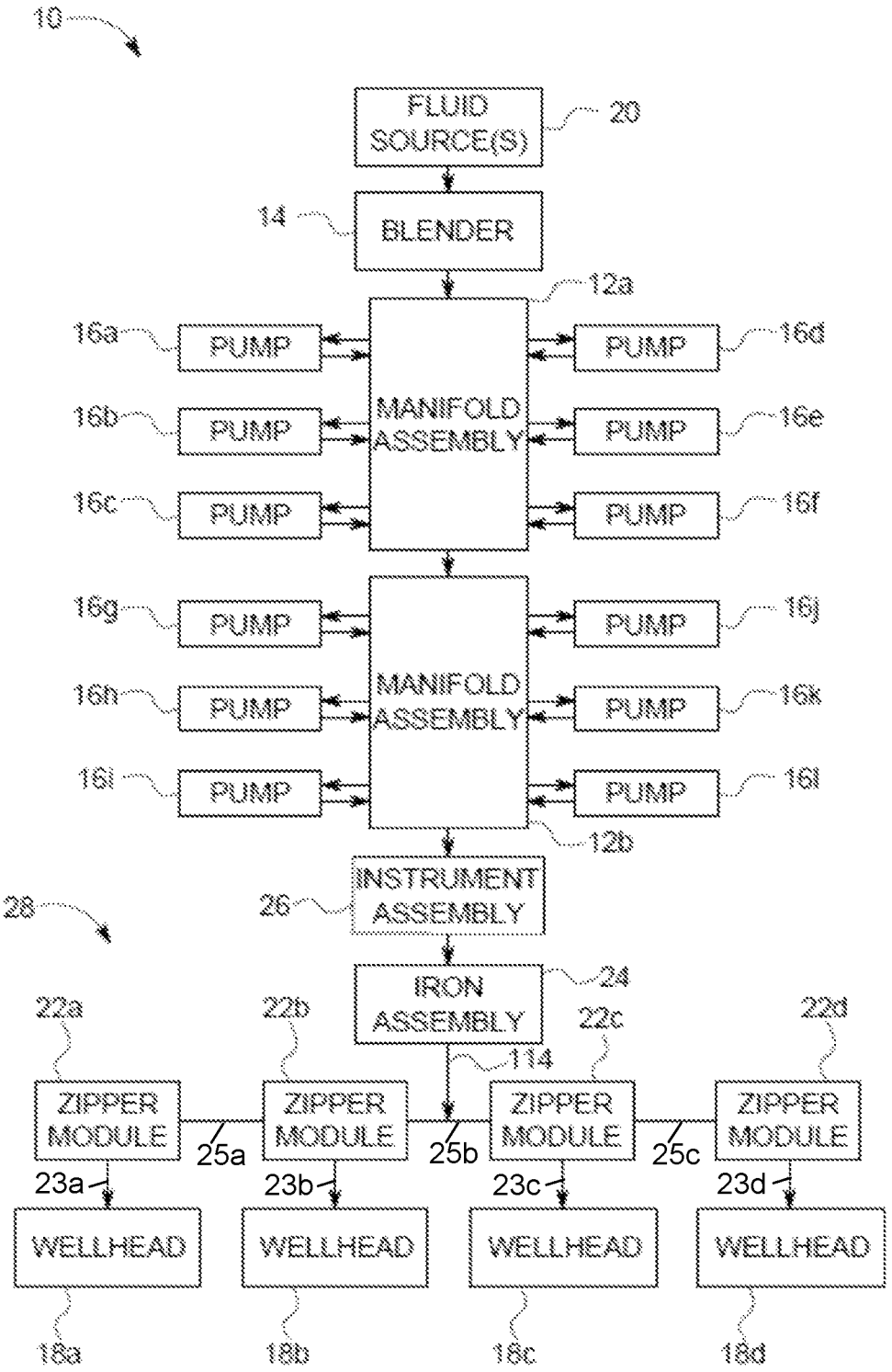
FIG. 1 is a block diagram of a system for supplying fracturing fluid to a wellhead, according to one example.

Several embodiments for using a single straight-line (or one straight line) connection between different parts of a fracking operation are disclosed herein. For purposes of this disclosure, a "single straight-line" and "one straight-line" connection refers to a series of pipes (e.g., plug, gate, etc.); valves; or other frac iron connected together to define an internal path, or conduit, for frack fluid or flowback to respectively flow therethrough. As described in more detail below, the single straight-line connections formed from the connected pipes, gates, or other frac iron may connect may be used to provide a fluid path for frack fluid between a zipper module and a frac tree (or Christmas tree) or between the frac tree and flowback equipment. The single straight-line connections described herein are made up of the various piping, vales, and frac iron, span from or two the frac tree in one direction along a straight line.

"Straight line," in reference to the single straight-line connections described herein, means a straight path at a constant height, through a midpoint of a fluid pathway created by the connected pipes, valves, or other frac iron, between a frac tree and zipper module or between two zipper modules. In other words, in some embodiments, the single straight-line connections have no bends, or curves, defining a fluid channel that is a true straight flow path for flowback operations (e.g., frac tree to flowback container) or pressure-pumping operations (e.g., zipper module to zipper module, or zipper module to frac tree). For example, a single straight-line connection may have a straight line between the fluid path within fluid channel of the pipes, valves, or frac iron have an inner midpoint that measures 5, 6, 7, or 10 feet high all the way between a zipper module and a frac tree.

Not all embodiments are limited to a constant height, however. Alternatively, in some embodiments, the single straight-line connections described herein may be angled between the flowback equipment and the frac tree, between the zipper modules described below and the frac tree, or between the zipper modules themselves. For example, in pressure-pumping operations, a single straight-line connection between a zipper module and a frac tree may be angled upward, downward, leftward, or rightward at an angle of 1-15 degrees (e.g., 1, 2, 3, 4, 5, 6, 7, 8, 9, 10, 11, 12, 13, 14, or 15 degrees). Single straight-line connections may be similarly angled between the frac tree and the flowback container, or between two zipper modules.

Generally, the single straight-line connections disclosed herein may be used to either deliver frack fluid to the frac tree or carry flowback away from the frac tree. The single straight-line connections are much less complicated than conventional connections between zipper modules and frac trees or between flowback equipment and frac trees, providing both single-point and straight connections between frac trees and frac-fluid pumping or flowback equipment.

To aid the reader, the description below and accompanying drawings are set out in the following manner: FIGS. 1-13 reference straight-line connections made to facilitate frac-fluid pumping to a frac tree on a wellhead, and FIGS. 14-15 reference straight-line connections between the frac tree and flowback equipment for capturing flowback after frac-fluid pressure pumping. Together, the single straight-line connections disclosed herein may be used in an integrated setup, providing much less complex and safer conduits for supplying frack fluid to a wellhead and collecting flowback from the wellhead. For instance, the single straight-line connections in FIGS. 1-13, and equivalents thereof, may be used to frack a site. Once fracking is complete, the single straight-line connections in FIGS. 14-15 may be used to carry flowback to flowback equipment, such as sand pits, reservoirs, torches, collection tanks, and the like.

The single straight-line connections disclosed herein may be formed by different combinations of "frac iron." Frac iron, as reference herein, refers to component parts used to frack a well or capture flowback. Frac iron may include, for example, high pressure treating iron, and other pipes, joints, valves, and fittings; swivel joints, pup joints, plug valves, check valves and relief valves; ball injector, crow's foot, air chamber, crossover, hose, pipes/piping, hose loop, ball injector tee body, tee, wye, lateral, ell, check valve, plug valve, wellhead adapter, swivel joint, plug, relief valve; or the like.

Having generally described different implementations of the single straight-line connections disclosed herein, attention is directed to the accompanying drawings. FIG. 1 illustrates a block diagram of an example setup for hydraulic fracking of a subterranean layer for oil and/or gas extraction. The embodiment shown in FIG. 1 is a setup for communicating fracking fluid to wellheads 18*a-d* out in the field. In this vein, a system generally referred to by the reference numeral 10 includes manifold assemblies 12*a* and 12*b* that are used for pressure-pumping operations to supply frack fluid to wellheads 18*a-d*. In some embodiments, the manifold assemblies 12*a* and 12*b* are in fluid communication with a blender 14, pumps 16*a*-1, and wellheads 18*a-d*. One or more fluid sources 20 of frack fluid are in fluid communication with the blender 14.

The wellheads 18*a-d* are each located at the top or head of an oil and gas wellbore (not shown), which penetrates one or more subterranean formations (not shown), and are used in oil and gas exploration and production operations. The wellheads 18*a-d* are in fluid communication with the manifold assemblies 12*a* and 12*b* via, for example, via zipper modules 22*a-d*, an iron assembly 24, and an instrument assembly 26.

The zipper modules 22*a-d* are operably coupled to the wellheads 18*a-d*, respectively, via single straight-line connections 23*a-d*, as well as being connected between zipper modules 22*a-d* via single straight-line connections 25*a-c*. Together, the zipper modules 22*a-d* and single straight-line connections 23*a-d* and 25*a-c* form a zipper manifold 28 to which the iron assembly 24 is operably coupled. Thus, the fluid conduit 93 of the iron assembly 24 is operably coupled to, and in fluid communication with, the zipper manifold 28. And the instrument assembly 26 is operably coupled to both the iron assembly 24 and the manifold assemblies 12*a* and 12*b*. In an exemplary embodiment, the one or more fluid sources 20 include fluid storage tanks, other types of fluid sources, natural water features, or any combination thereof.

System 10 may be used in hydraulic fracturing operations to facilitate oil and gas exploration and production operations. Alternatively, embodiments provided herein may be used with, or adapted to, a mud pump system, a well treatment system, other pumping systems, one or more systems at the wellheads 18*a-d*, one or more systems in the wellbores of which the wellheads 18*a-d* are the surface terminations, one or more systems downstream of the wellheads 18*a-d*, or one or more other systems associated with the wellheads 18*a-d*.

In several embodiments, the manifold assemblies 12*a* and 12*b* are identical to one another and, therefore, in connection with FIGS. 2-4, only the manifold assembly 12*a* will be described in detail below; however, the description may be applied to every one of the manifold assemblies 12*a* and 12*b*. Moreover, in several embodiments, the pumps 16*g*-1 are connected to the manifold assembly 12*b* in substantially the same manner that the pumps 16*a-f* are connected to the manifold assembly 12*a* and, therefore, in connection with FIGS. 2-4, only the connection of the pumps 16*a-f* to the manifold assembly 12*a* will be described in detail below; however, the description below applies equally to the manner in which the pumps 16*g*-1 are connected to the manifold assembly 12*b*.

A flexible joint 114 may be used to connect the iron assembly 24 to a middle connection between the zipper module 22*b* and 22*c*. This is one example, whereby a tee connection dispels fluid from the spherical swivel connection to each of the zipper modules 22*b* and 22*c*. Alternatively, the flexible joint 114 is positioned directly between the iron assembly 24, the instrument assembly 26, or the manifold assembly 12*b* and one of the zipper modules 22*a-d*, which in turn distributes fluid to its respective wellhead 18*a-c* and also at least one other zipper module 22*a-d* that are connected in series.

Figure 2:
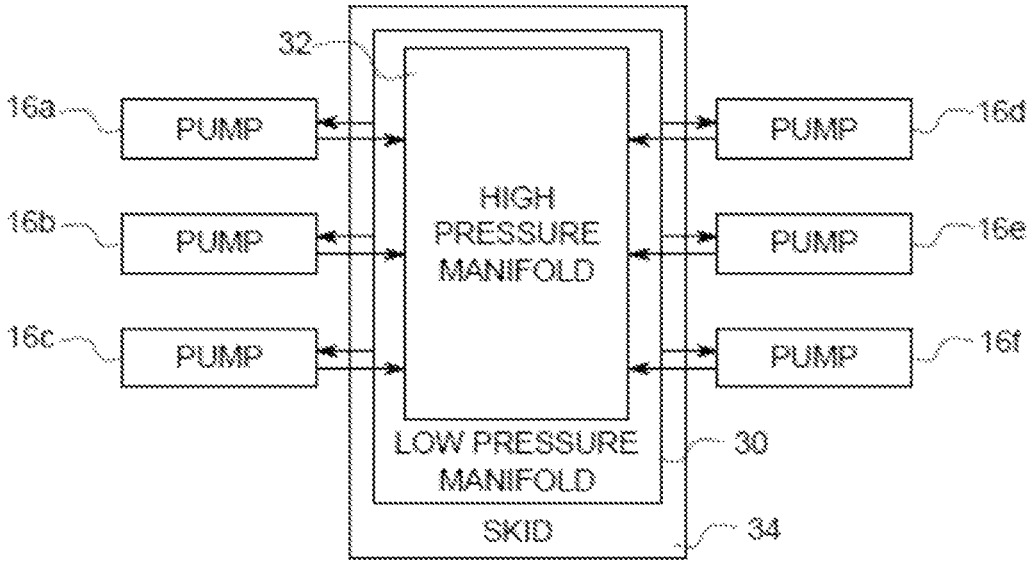
FIG. 2 is a schematic illustration of a manifold assembly including a high-pressure manifold, a low-pressure manifold, and a skid, according to one example.

FIG. 2 is a block illustration of the manifold assembly of FIG. 1, the manifold assemblies 12*a* or 12*b* include, in some examples, a high-pressure manifold 32, a low-pressure manifold 30, and a skid. In some examples, the manifold assembly 12*a* described in FIG. 1 includes a low-pressure manifold 30 and a high-pressure manifold 32, both of which may be mounted on, or connected to, a skid 34. Skid 34 may be equipped with wheels, bearing, skid(s) or other ways to move independently, thereby enabling the skid 34 to easily be rolled or moved into place.

Alternatively or additionally, the skid 34 may be attached to a trailer that is itself moveable or affixed to a truck or railcar. In some examples, the pumps 16*a-f* are in fluid communication with each of the low-pressure manifold 30 and the high-pressure manifold 32. In some examples, the pumps 16*a-f* include or are part of a positive displacement pump, a reciprocating pump assembly, a frac pump, a pump truck, a truck, a trailer, or any combination thereof. For example, pumps 16*a-f* may be an SPM® Destiny® TWS 2250 or 2500 Frac Pump, manufactured by S.P.M. Flow Control, Inc., headquartered in Fort Worth, Tex.

Figure 3:
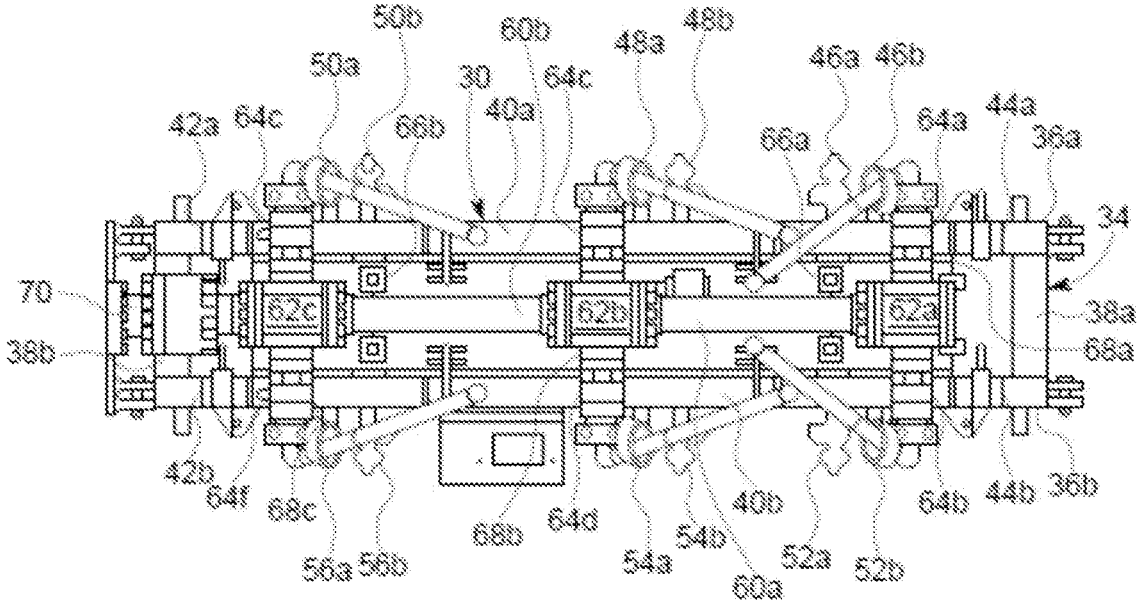
FIGS. 3 and 4 are top and side views, respectively, of a manifold assembly, according to one example.
Figure 4:
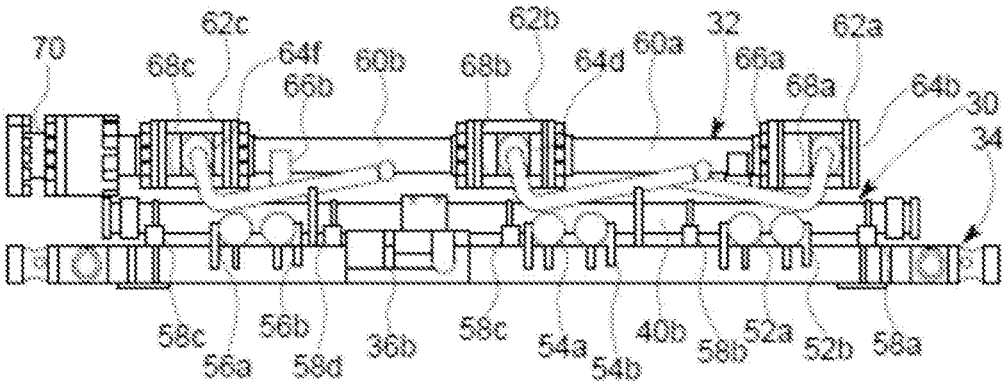

FIGS. 3 and 4 illustrate top and side views of the skid 34 for the manifold assemblies 12*a* and 12*b* with the aforementioned low-pressure manifold 30 and high-pressure manifold 32. As shown in FIGS. 3 and 4, the skid 34 includes, among other things, longitudinally-extending structural members 36*a* and 36*b*, transversely-extending end members 38*a* and 38*b* connected to respective opposing end portions of the longitudinally-extending structural members 36*a* and 36*b*, and transversely-extending structural members (not shown in FIGS. 3 and 4) connecting the longitudinally-extending structural members 36*a* and 36*b*.

The low-pressure manifold 30 includes longitudinally-extending tubular members, or flow lines 40*a* and 40*b*, that are connected to the skid 34 between the transversely-extending end members 38*a* and 38*b* thereof. The flow lines 40*a* and 40*b* are in fluid communication with the blender 14. In some embodiments, the low-pressure manifold 30 further includes a transversely-extending tubular member, or rear header (not shown), via which the blender 14 is in fluid communication with the flow lines 40*a* and 40*b*. In some embodiments, the flow lines 40*a* and 40*b* are spaced in a parallel relation, and include front end caps 42*a* and 42*b* respectively, and, in those embodiments where the rear header is omitted, rear end caps 44*a* and 44*b*.

In some examples, the pumps 16*a*, 16*b* and 16*c* shown in FIG. 2 (though, not shown in FIGS. 3 and 4) are in fluid communication with the flow line 40*a* via one of outlet ports 46*a* and 46*b*, one of outlet ports 48*a* and 48*b*, and one of outlet ports 50*a* and 50*b*, respectively. Connections between the flow line 40*a* and any of outlet ports 46*a* and/or 46*b*, outlet ports 48*a* and/or 48*b*, and outlet ports 50*a* and/or 50*b* may be made using one or more hoses, piping, swivels, flowline components, other components, or any combination thereof.

In some examples, the outlet ports 46*a*, 46*b*, 48*a*, 48*b*, 50*a*, and 50*b* are connected to the flow line 40*a*. In an exemplary embodiment, the pumps 16*a*, 16*b*, and 16*c* (not shown in FIGS. 3 and 4) are in fluid communication with the flow line 40*a* via both of the outlet ports 46*a* and 46*b*, both of the outlet ports 48*a* and 48*b*, and both of the outlet ports 50*a* and 50*b*, respectively. Fluid may then be injected using via piping, flowline components, frac iron, or other connective components.

Additionally or alternatively, in some examples, the pumps 16*d*, 16*e* and 16*f* of FIG. 2 (though, not shown in FIGS. 3 and 4) are in fluid communication with the flow line 40*b* via one of outlet ports 52*a* and 52*b*, one or outlet ports 54*a* and 54*b*, and one of outlet ports 56*a* and 56*b*, respectively. Connections between the flow line 40*b* and any of outlet ports 52*a* and/or 52*b*, outlet ports 54*a* and 54*b*, and one of outlet ports 56*a* and 56*b*, respectively, may be made using various piping, flowline components, or other connective components.

In some examples, the outlet ports 52*a*, 52*b*, 54*a*, 54*b*, 56*a*, and 56*b* are connected to the flow line 40*b*. In some examples, the pumps 16*d*, 16*e*, and 16*f* of FIG. 2 are in fluid communication with the flow line 40*b* via both of the outlet ports 52*a* and 52*b*, both of the outlet ports 54*a* and 54*b*, and both of the outlet ports 56*a* and 56*b*, respectively. Such fluid communication may be made with various hoses, piping, flowline components, other components, or any combination thereof.

Looking at FIG. 4, in some examples, the flow line 40*a* is mounted to the skid 34 via low-pressure mounts 58*a*, 58*b*, 58*c*, 58*d*, and 58*e* (visible in FIG. 4). Reciprocal low-pressure mounts 58 may be located on the other side of the skid 34 not shown in FIG. 4. In some examples, the low-pressure manifold 30 is connected to the skid 34 by lowering the low-pressure manifold 30 down and then ensuring that a respective upside-down-u-shaped or upside-down-v-shaped brackets extend about the flow lines 40*a* and 40*b* and engage the low-pressure mounts 58.

In some examples, the high-pressure manifold 32 includes longitudinally-extending tubular members, or flow lines 60*a* and 60*b*, and flow fittings 62*a-c* operably coupled to, and in fluid communication with, the flow lines 60*a* and 60*b*. The flow lines 60*a* and 60*b* and the flow fittings 62*a-c* are supported by the skid 34 between the transversely-extending end members 38*a* and 38*b* thereof. The flow fittings 62*a* and 62*b* are coupled to opposing end portions of the flow line 60*a*, and the flow fittings 62*b* and 62*c* are coupled to opposing end portions of the flow line 60*b*. As a result, the flow fitting 62*b* interconnects the flow lines 60*a* and 60*b*, and the flow fittings 62*a* and 62*c* are located proximate the transversely-extending end members 38*a* and 38*b*, respectively, of the skid 34.

In some examples, the flow lines 60*a-b* through which frack iron is pumped are considered "large bore" flow iron, meaning the flow lines 60*a-b* have an inner bore diameter of 4-9 inches. For example, the inner bores may be 4, 4½, 5, 5½, 6, 6½, 7, 7½, 8, 8½ inches, or any measurement in between. The inner bore may be any type of internal geometric shapes, e.g., circular, ellipsoidal, rectangular, square, triangular, or the like.

In some embodiments, the pumps 16*a*, 16*b*, and 16*c* shown in FIG. 2 (though, not shown in FIGS. 3 and 4) are in fluid communication with the respective flow fittings 62*a*, 62*b*, and 62*c* via isolation valves 64*a*, 64*c*, and 64*e*, respectively. Such fluid communication may flow through one or more hoses, piping, flowline components, other components, or any combination thereof. Similarly, the pumps 16*d*, 16*e*, and 16*f* shown in FIG. 2 (though, not shown in FIGS. 3 and 4) are, in some embodiments, in fluid communication with the respective flow fittings 62*a*, 62*b*, and 62*c* via isolation valves 64*b*, 64*d*, and 64*f*, respectively. Such fluid communication may flow through one or more hoses, piping, flowline components, other components, or any combination thereof.

The flow lines 60*a* and 60*b* and the flow fittings 62*a*, 62*b*, and 62*c* are mounted to the skid 34 via a combination of vertically-extending high pressure mounts 66*a* and 66*b* and mounting brackets 68*a*, 68*b*, and 68*c*. In some examples, the high-pressure manifold 32 is connected to the skid 34 by lowering the high-pressure manifold 32 down and then ensuring that the flow lines 60*a* and 60*b* are supported by the high-pressure mounts 66*a* and 66*b*, respectively, and that the flow fittings 62*a*, 62*b*, and 62*c* are supported by the mounting brackets 68*a*, 68*b*, and 68*c*, respectively.

In some embodiments, with continuing reference to FIGS. 1-4, the high-pressure manifold 32 of the manifold assembly 12*a* is operably coupled to, and in fluid communication with, the high-pressure manifold 32 of the manifold assembly 12*b*. Specifically, the flow fitting 62*c* of the manifold assembly 12*a* may be connected to the flow fitting 62*a* of the manifold assembly 12*b* via a universal fitting, such as, for example, a spherical joint 70 (a portion of which is shown in FIGS. 3 and 4). The spherical joint 70 may be designed to accommodate any vertical and/or horizontal offset between the high-pressure manifold 32 of the manifold assembly 12*a* and the high-pressure manifold 32 of the manifold assembly 12*b*.

Figure 5:
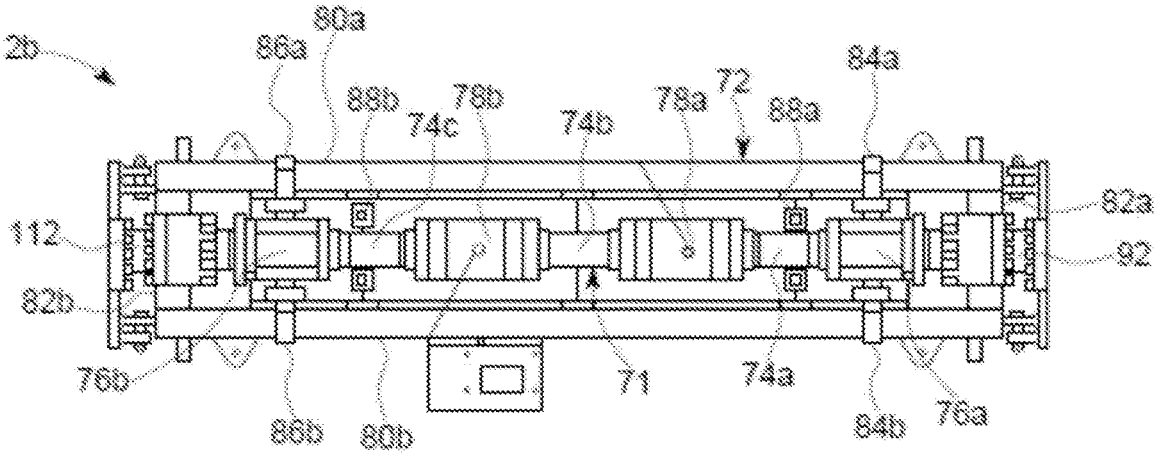
FIGS. 5 and 6 are top and side views, respectively, of an instrument assembly, according to one example.
Figure 6:
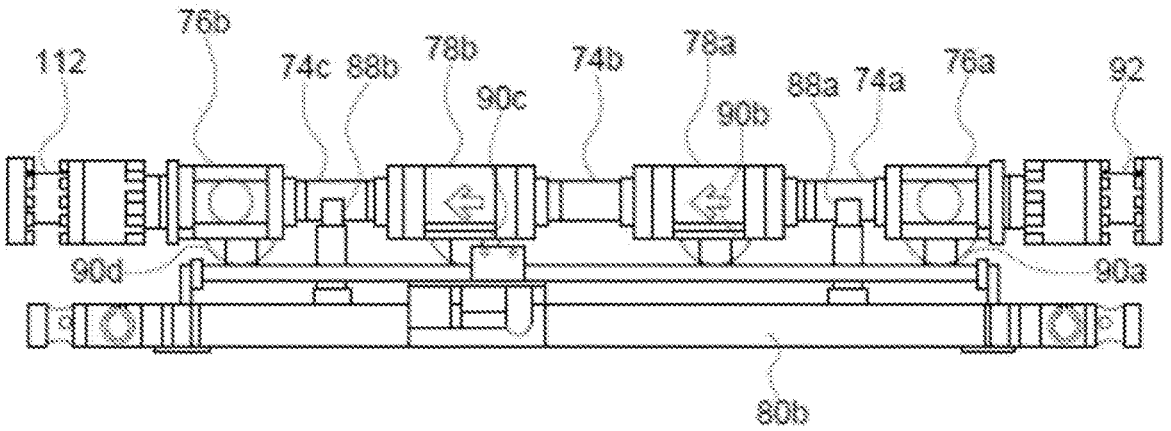

FIGS. 5 and 6 illustrate examples of an instrument assembly, as described above in reference to FIG. 1. In some examples, as illustrated in FIGS. 5 and 6 with continuing reference to FIG. 1, the instrument assembly 26 includes a fluid conduit 71 that is mounted on, and connected to, a skid 72. The fluid conduit 71 includes longitudinally-extending tubular members, or flow lines 74*a*, 74*b*, and 74*c*, flow fittings 76*a* and 76*b*, and valves 78*a* and 78*b*. The skid 72 includes, among other things, longitudinally-extending structural members 80*a* and 80*b*, transversely-extending end members 82*a* and 82*b* connected to respective opposing end portions of the longitudinally-extending structural members 80*a* and 80*b*, and transversely-extending structural members (not shown in FIGS. 5 and 6) connecting the longitudinally-extending structural members 80*a* and 80*b*. The flow lines 74*a*, 74*b*, and 74*c*, the flow fittings 76*a* and 76*b*, and the valves 78*a* and 78*b* are connected in series and supported by the skid 72 between the transversely-extending end members 82*a* and 82*b* thereof.

The flow fittings 76*a* and 76*b* and the valves 78*a* and 78*b* are operably coupled to, and in fluid communication with, the flow lines 74*a*, 74*b*, and 74*c*. Specifically, respective opposing end portions of the flow lines 74*a*, 74*b*, and 74*c* are operably coupled to the flow fitting 76*a* and the valve 78*a*, the valves 78*a* and 78*b*, and the valve 78*b* and the flow fitting 76*b*, respectively. As a result, the valve 78*a* interconnects the flow lines 74*a* and 74*b*, the valve 78*b* interconnects the flow lines 74*b* and 74*c*, the flow fitting 76*a* is operably coupled to the flow line 74*a* proximate (e.g., within 1, 2, 3, or 4 feet, in some examples) the transversely-extending end member 82*a* of the skid 72, and the flow fitting 76*b* is operably coupled to the flow line 74*b* proximate the transversely-extending end member 82*b* of the skid 72.

Valves 78*a* and 78*b* may be plug valves and/or check valves in different examples. In some examples, the valve 78*a* is a plug valve and the valve 78*b* is a check valve.

In an exemplary embodiment, ports 84*a* and 84*b* of the flow fitting 76*a* and/or ports 86*a* and 86*b* of the flow fitting 76*b* may be used to establish fluid communication with the fluid conduit 71, for example using one or more hoses, piping, flowline components, other components, or any combination thereof. Additionally, such fluid communication may be used, for example, to support instrumentation (not shown in FIGS. 5 and 6) for measuring certain characteristics of fluid exiting the respective high-pressure manifolds 32 of the manifold assemblies 12*a* and 12*b*.

The flow lines 74*a*, 74*b*, and 74*c*, the flow fittings 76*a* and 76*b*, and the valves 78*a* and 78*b* are mounted to the skid 72 via a combination of vertically-extending high pressure mounts 88*a* and 88*b* and mounting brackets 90*a*, 90*b*, 90*c*, and 90*d*. In some examples, the fluid conduit 71 is connected to the skid 72 by lowering the fluid conduit 71 down and then ensuring that the flow lines 74*a* and 74*c* are supported by the high-pressure mounts 88*a* and 88*b*, respectively, that the flow fittings 76*a* and 76*b* are supported by the mounting brackets 90*a* and 90*d*, and that the valves 78*a* and 78*b* are supported by the mounting brackets 90*b* and 90*c*.

In several exemplary embodiments, with continuing reference to FIGS. 1, 5, and 6, the high-pressure manifold 32 of the manifold assembly 12*b* is operably coupled to, and in fluid communication with, the fluid conduit 71 of the instrument assembly 26. More particularly, the flow fitting 62*c* of the manifold assembly 12*b* is connected to the flow fitting 76*a* of the instrument assembly 26 via a universal fitting, such as, for example, the spherical joint 92, which operably accommodates any vertical and/or horizontal offset between the high-pressure manifold 32 of the manifold assembly 12*b* and the fluid conduit 71 of the instrument assembly 26.

Figure 7:
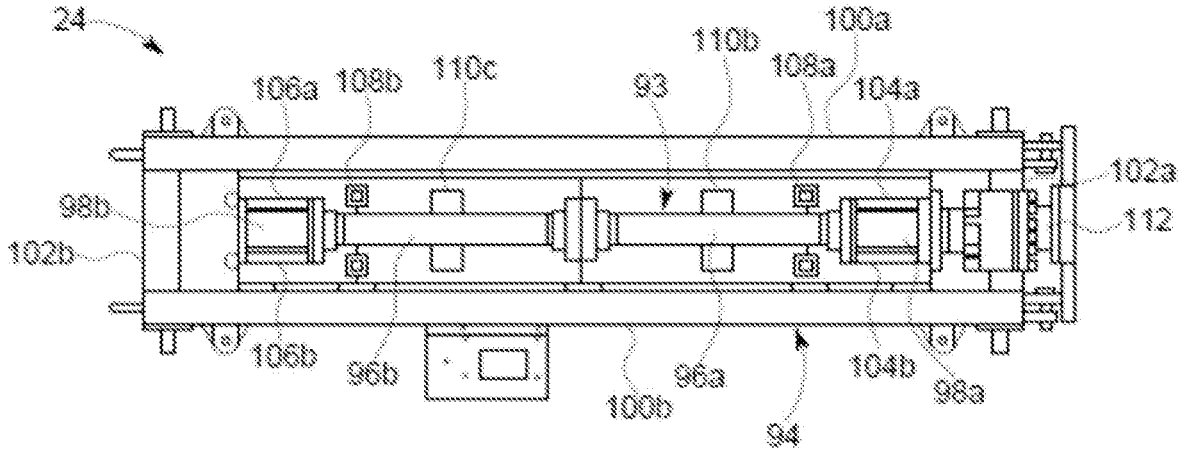
FIGS. 7 and 8 are top and side views, respectively, of an iron assembly, according to one example.
Figure 8:
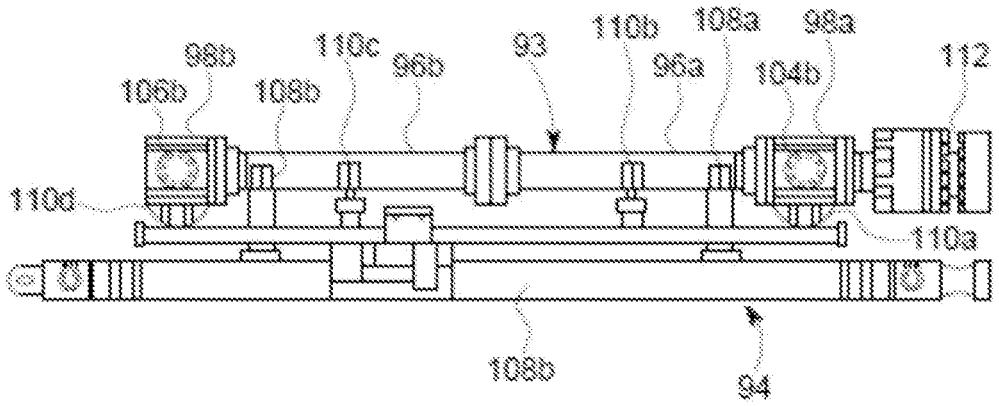

In some examples, as illustrated in FIGS. 7 and 8 with continuing reference to FIG. 1, the iron assembly 24 includes a fluid conduit 93 that is mounted on, and connected to, a skid 94. The fluid conduit 93 includes longitudinally-extending tubular members, or flow lines 96*a* and 96*b*, and flow fittings 98*a* and 98*b*. The skid 94 includes, inter alia, longitudinally-extending structural members 100*a* and 100*b*, transversely-extending end members 102*a* and 102*b* connected to respective opposing end portions of the longitudinally-extending structural members 100*a* and 100*b*, and transversely-extending structural members (not shown in FIGS. 7 and 8) connecting the longitudinally-extending structural members 100*a* and 100*b*. The flow lines 96*a* and 96*b* and the flow fittings 98*a* and 98*b* are connected in series and supported by the skid 94 between the transversely-extending end members 102*a* and 102*b* thereof.

The flow fittings 98*a* and 98*b* are operably coupled to, and in fluid communication with, the flow lines 96*a* and 96*b*. Specifically, the flow fittings 98*a* and 98*b* are operably coupled to the flow lines 96*a* and 96*b*, respectively, and the flow lines 96*a* and 96*b* are operably coupled to each other. As a result, the flow fitting 98*a* is operably coupled to the flow line 96*a* proximate the transversely-extending end member 102*a* of the skid 94, and the flow fitting 98*b* is operably coupled to the flow line 96*b* proximate the transversely-extending end member 102*b* of the skid 94. In some examples, ports 104*a* and 104*b* of the flow fitting 98*a* and/or ports 106*a* and 106*b* of the flow fitting 98*b* may be used to establish fluid communication with the fluid conduit 93.

In some examples, the flow lines 96*a* and 96*b* and the flow fittings 98*a* and 98*b* are mounted to the skid 94 via a combination of vertically-extending high pressure mounts 108*a* and 108*b* and mounting brackets 110*a*, 110*b*, 110*c*, and 110*d*. The fluid conduit 93 may be connected to the skid 94 by lowering the fluid conduit 93 down and then ensuring that the flow lines 96*a* and 96*b* are supported by the high-pressure mounts 108*a* and 108*b* and the mounting brackets 110*b* and 110*c*, respectively, and that the flow fittings 98*a* and 98*b* are supported by the mounting brackets 110*a* and 110*d*, respectively.

In several examples, with continuing reference to FIGS. 1 and 5-8, the fluid conduit 71 of the instrument assembly 26 is operably coupled to, and in fluid communication with, the fluid conduit 93 of the iron assembly 24. More particularly, the flow fitting 76*b* of the instrument assembly 26 may be connected to the flow fitting 98*a* of the iron assembly 24 via a spherical joint 112 (respective portions of which are shown in FIGS. 5-8).

As indicated above, with continuing reference to FIG. 1, the wellheads 18*a-d* are each located at the top or head of an oil and gas wellbore, which penetrates one or more subterranean formations, and are used in oil and gas exploration and production operations. In several embodiments, frac trees 158*a-d* (otherwise known as Christmas trees) are operably coupled to the wellheads 18*a-d*, respectively. The frac trees 158*a-d* may be substantially identical to each other (as may the wellheads 18*a-d*). Therefore, in connection with FIG. 9, only the frac tree 158*a* will be described in detail below. Though, the description below applies to every one of the frac trees 158*a-d*.

Figure 9:
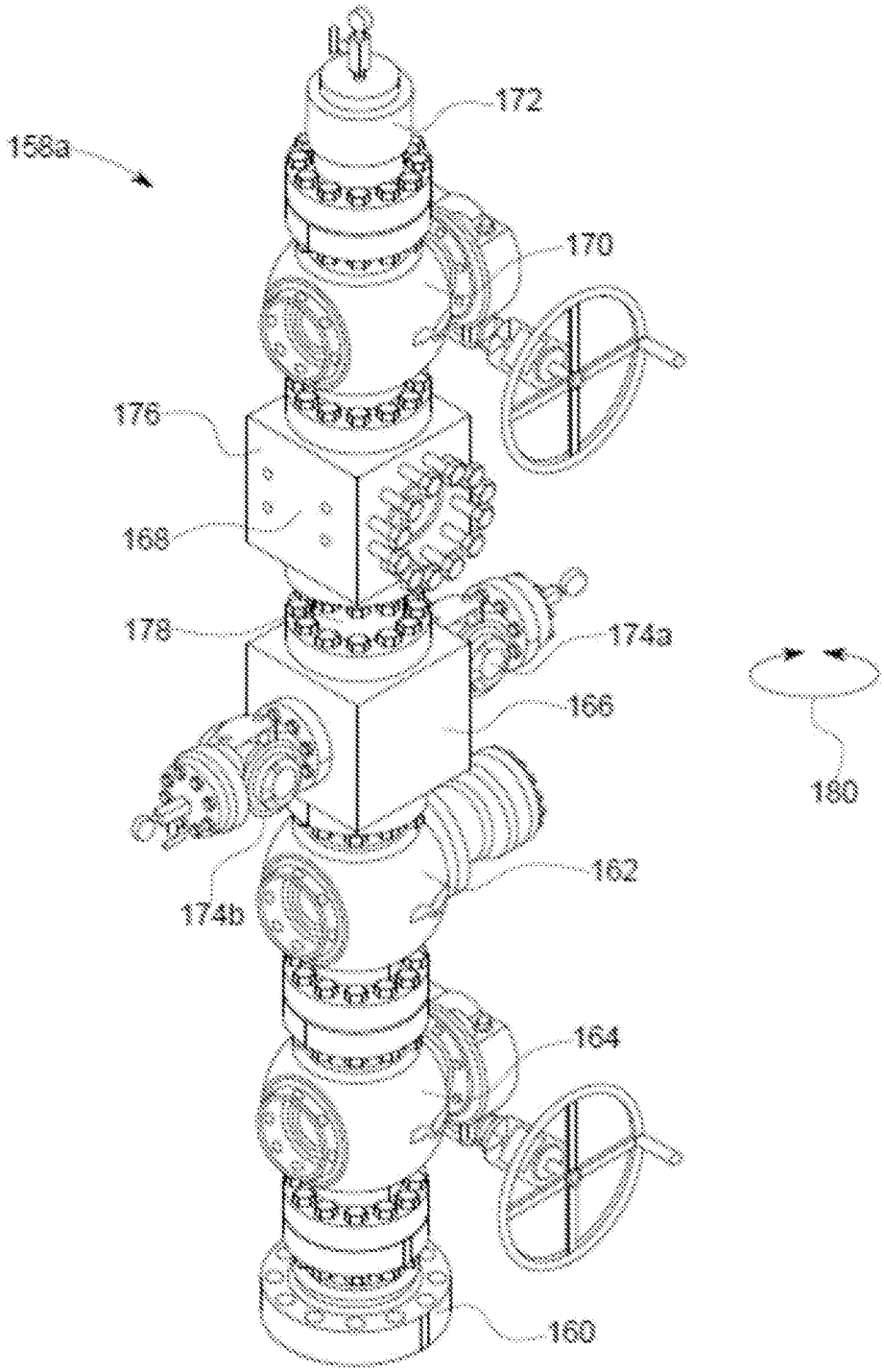
FIG. 9 is a perspective view of a frac tree operably coupled to a wellhead, according to one example.

FIG. 9 illustrates a perspective view of a frac tree that is configured to receive a single straight-line connection, either for pressure-pumping or flowback operations. As depicted, the frac tree 158*a* includes an adapter spool 160; a pair of master valves (such as, for example, upper and lower plug valves 162 and 164); a production tee 166; a swivel assembly 168; a swab valve (such as, for example, a plug valve 170); and a tree adapter 172. In some embodiments, the upper and lower plug valves 162 and 164 are operably coupled in series to one another above the adapter spool 160. In several exemplary embodiments, the upper plug valve 162 of the frac tree 158*a* is an automatic plug valve, and the lower plug valve 164 is a manual plug valve. The adapter spool 160 facilitates the connection between different sized flanges of the wellhead 18*a* (not shown in FIG. 10) and the lower plug valve 164. The production tee 166 is operably coupled to the upper plug valve 162 and includes a production wing valve 174*a* and a kill wing valve 174*b* connected thereto. The swivel assembly 168 is operably coupled to the production tee 166, opposite the upper plug valve 162, and includes a swivel tee 176 rotatably connected to a swivel spool 178. The swivel tee 176 of the frac tree 158*a* is configured to rotate about a vertical axis and relative to the swivel spool 178, the production tee 166, the upper and lower plug valves 162 and 164, and the adapter spool 160, as indicated by the curvilinear arrow 180 in FIG. 9. The tree adapter 172 is operably coupled to the plug valve 170 opposite the swivel assembly 168, and includes a cap and gauge connected thereto to verify closure of the plug valve 170. Frac tree 158 defines a vertical inner bore pathway for frack fluid to flow through the shown assembly of valves, adapters, and assemblies.

Figure 10:
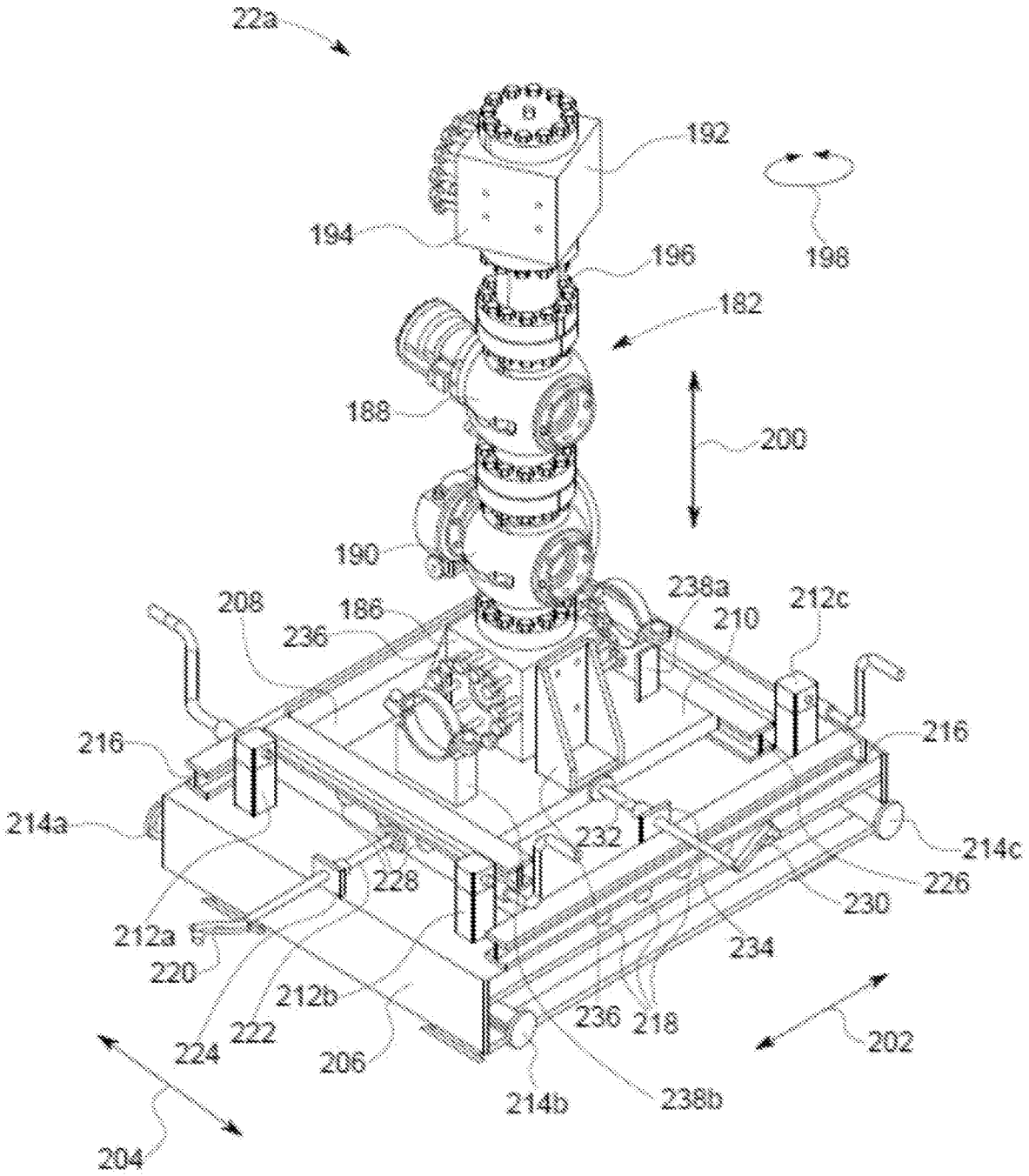
FIG. 10 is a perspective view of a zipper module, according to one example.

As indicated above, with continuing reference to FIG. 1, for pressure-pumping operations, the zipper manifold 28 is formed by the interconnection of the zipper modules 22*a-d*, which zipper modules, in turn, are operably coupled to the wellheads 18*a-d*, respectively. Referring additionally to FIG. 10, an example of one of the zipper modules 22*a-d* is illustrated. In several exemplary embodiments, the zipper modules 22*a-d* are substantially identical to each other, and, therefore, in connection with FIG. 10, only the zipper module 22*a* will be described in detail below. However, the description below applies to every one of the zipper modules 22*a-d*. The zipper module 22*a* includes a vertical zipper stack 182 supported by an adjustable zipper skid 184.

Figure 11:
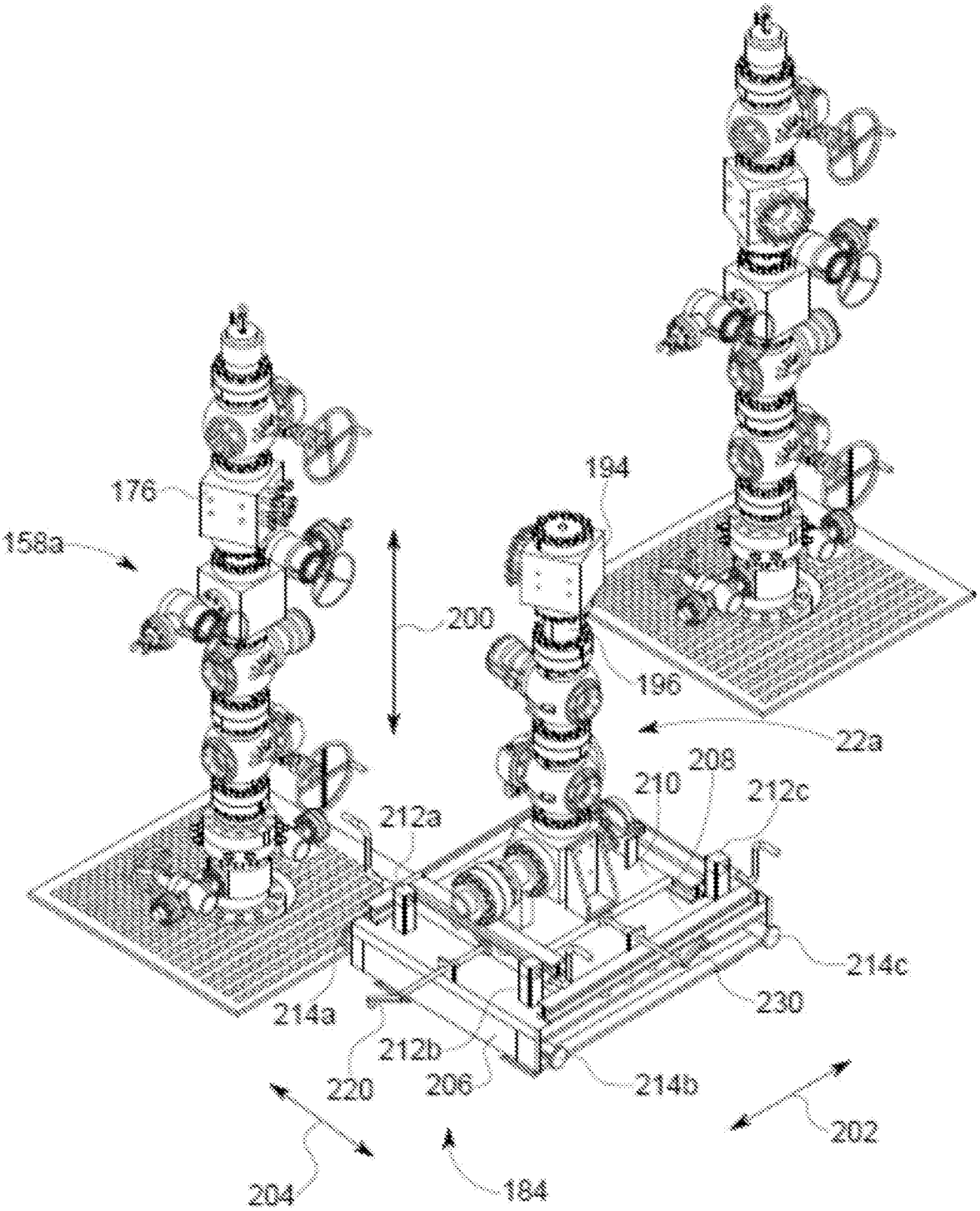
FIGS. 11-13 are perspective views illustrating one or more zipper modules being connected to frac trees using single straight-line connections, according to some examples.

In an example, as illustrated in FIG. 11 with continuing reference to FIG. 1, the vertical zipper stack 182 used in pressure-pumping operations includes a connection tee 186, a pair of valves, such as, for example, upper and lower plug valves 188 and 190, and a swivel assembly 192. The upper and lower plug valves 188 and 190 are operably coupled in series to one another, the lower plug valve 190 being operably coupled to the connection tee 186. In several exemplary embodiments, the upper plug valve 188 of the vertical zipper stack 182 is an automatic plug valve, and the lower plug valve 190 is a manual plug valve. The swivel assembly 192 is operably coupled to the upper plug valve 188, opposite the lower plug valve 190 and the connection tee 186, and includes a swivel tee 194 rotatably connected to a swivel spool 196. The swivel tee 194 of the vertical zipper stack 182 is configured to rotate about a vertical axis and relative to the swivel spool 196, the upper and lower plug valves 188 and 190, and the connection tee 186, as indicated by the curvilinear arrow 198 in FIG. 10.

In some examples, the adjustable zipper skid 184 is configured to displace the zipper stack 182 to align the swivel tee 194 of the zipper module 22*a* with the corresponding swivel tee 176 of the frac tree 158*a*, as will be described in further detail below. More particularly, the adjustable zipper skid 184 is configured to displace the zipper stack 182 up and down in the vertical direction, and back and forth in at least two horizontal directions, as indicated by the linear arrows 200, 202, and 204, respectively, in FIG. 10. In several examples, the vertical direction 200 and the at least two horizontal directions 202 and 204 are orthogonal.

In an exemplary embodiment, with continuing reference to FIG. 10, the adjustable zipper skid includes a generally rectangular base 206, a lower carriage plate 208 supported on the base 206, and an upper carriage plate 210 supported on the lower carriage plate 208. The base 206 includes vertical jacks 212*a-d* (the jack 212*d* is not visible in FIG. 11) and lifting pegs 214*a-d* (the lifting peg 214*d* is not visible in FIG. 11). The lifting pegs 214*a-d* are configured to facilitate placement of the adjustable zipper skid 184 on a generally horizontal surface proximate one of the frac trees 158*a-d* via, for example, a crane, a forklift, a front-end loader, or another lifting mechanism. The vertical jacks 212*a-d* are operably coupled to respective corners of the base 206 so that, when the adjustable zipper skid 184 is positioned on the generally horizontal surface proximate one of the frac trees 158*a-d*, the jacks 212*a-d* are operable to level, and to adjust the height of, the base 206 relative to the corresponding frac tree 158*a-d*, as will be described in further detail below.

The lower carriage plate 208 is operably coupled to the base 206 via, for example, a pair of alignment rails 216 and a plurality of rollers 218 disposed between the base 206 and the lower carriage plate 208. The rotation of a handcrank 220 displaces the lower carriage plate 208 in the horizontal direction 202 and relative to the base 206. More particularly, the handcrank 220 is connected to a threaded shaft 222 that is threadably engaged with a stationary mount 224 on the base 206, an end portion of the threaded shaft 222 opposite the handcrank 220 being operably coupled to the lower carriage plate 208. During the displacement of the lower carriage plate 208 in the horizontal direction 202 and relative to the base 206, the alignment rails 216 engage the lower carriage plate 208, thus constraining the movement of the lower carriage plate 208 to the horizontal direction 202 only.

Similarly, the upper carriage plate 210 is operably coupled to the lower carriage plate 208 via, for example, a pair of alignment rails 226 and a plurality of rollers 228 disposed between the lower carriage plate 208 and the upper carriage plate 210. The rotation of a handcrank 230 displaces the upper carriage plate 210 in the horizontal direction 204 and relative to both the lower carriage plate 208 and the base 206. More particularly, the handcrank 230 is connected to a threaded shaft 232 that is threadably engaged with a stationary mount 234 operably coupled to the base 206 via, for example, one of the alignment rails 216 of the lower carriage plate 208, an end portion of the threaded shaft 232 opposite the handcrank 230 being operably coupled to the upper carriage plate 210. During the displacement of the upper carriage plate 210 in the horizontal direction 204 and relative to both the lower carriage plate 208 and the base 206, the alignment rails 226 engage the upper carriage plate 210, thus constraining the movement of the upper carriage plate 210 to the horizontal direction 204 only.

In several exemplary embodiments, instead of or in addition to the use of handcranks, relative movement between the upper carriage plate 210 and the lower carriage plate 208 may be done by sliding the plate 210 relative to the plate 208, and vice versa, with a lubricant being disposed between the plates 210 and 208 to facilitate the relative sliding movement. Alternatively or additionally, the plates 208 and 210 may also be displaced by the application of external forces by way of a crane or forklift, for example A pair of mounting brackets 236 operably couples the connection tee 186 of the vertical zipper stack 182 to the upper carriage plate 210, opposite the rollers 228. Additionally, a pair of support brackets 238*a* and 238*b* are also coupled to the upper carriage plate 210 on opposing sides of the connection tee 186, the support brackets 238*a* and 238*b* being configured to facilitate the interconnection of the zipper modules 22*a-d* to from the zipper manifold 28, as will be described in further detail below.

As indicated above, with continuing reference to FIGS. 1, 9, and 10, during pressure-pumping operations when frack fluid is pumped to the wellheads 18*a-d*, the zipper modules 22*a-d* are operably coupled to the wellheads 18*a-d*, respectively, and are interconnected to form the zipper manifold 28. In several exemplary embodiments, the zipper modules 22*c* and 22*d* are incorporated into the zipper manifold 28 and operably coupled to the wellheads 18*c* and 18*d*, respectively, in substantially the same manner that the zipper modules 22*a* and 22*b* are incorporated into the zipper manifold 28 and operably coupled to the wellheads 18*a* and 18*b*, respectively. Therefore, in connection with FIGS. 12-16, only the incorporation of the zipper modules 22*a* and 22*b* into the zipper manifold 28 via, inter alia, the connection of the zipper modules 22*a* and 22*b* to the wellheads 18*a* and 18*b*, respectively, will be described in detail below; however, the description below applies equally to the manner in which the zipper modules 22*c* and 22*d* are incorporated into the zipper manifold 28 and operably coupled to the wellheads 18*c* and 18*d*, respectively.

In operation, a lifting mechanism (not shown), such as, for example, a crane, a forklift, a front-end loader, or the like, engages the lifting pegs 214*a-d* of the adjustable zipper skid 184 to place the zipper module 22*a* on the generally horizontal surface proximate the wellhead 18*a* (to which the frac tree 158*a* is operably coupled), as shown in FIG. 1. The vertical jacks 212*a-d* are then adjusted to vertically align the swivel tee 194 of the zipper module 22*a* with the swivel tee 176 of the frac tree 158*a*, and to level the base 206 of the zipper module 22*a*. Should the travel of the vertical jacks 212*a-d* be inadequate to substantially vertically align the swivel tee 194 of the zipper module 22*a* with the swivel tee 176 of the frac tree 158*a*, the swivel spool 196 of the vertical zipper stack 182 may be omitted in favor of another fixed-length fluid conduit, as will be discussed in further detail below.

The handcranks 220 and 230 of the zipper module 22*a* are used to move the carriage plates 208 and 210, respectively, and thus the vertical zipper stack 182, in the at least two horizontal directions 202 and 204, respectively. Such horizontal movement of the zipper module 22*a* adjusts the horizontal spacing between the swivel tees 176 and 194.

FIG. 11 illustrates a perspective view of a first zipper module 22*a* being positioned out in a field for connection to a frac tree 158*a*. Once the appropriate vertical alignment and horizontal spacing between the swivel tees 176 and 194 has been achieved through the use of the vertical jacks 212*a-d* and the handcranks 220 and 230, swivel tees 176 and 194 may be rotated to face each other.

Figure 12:
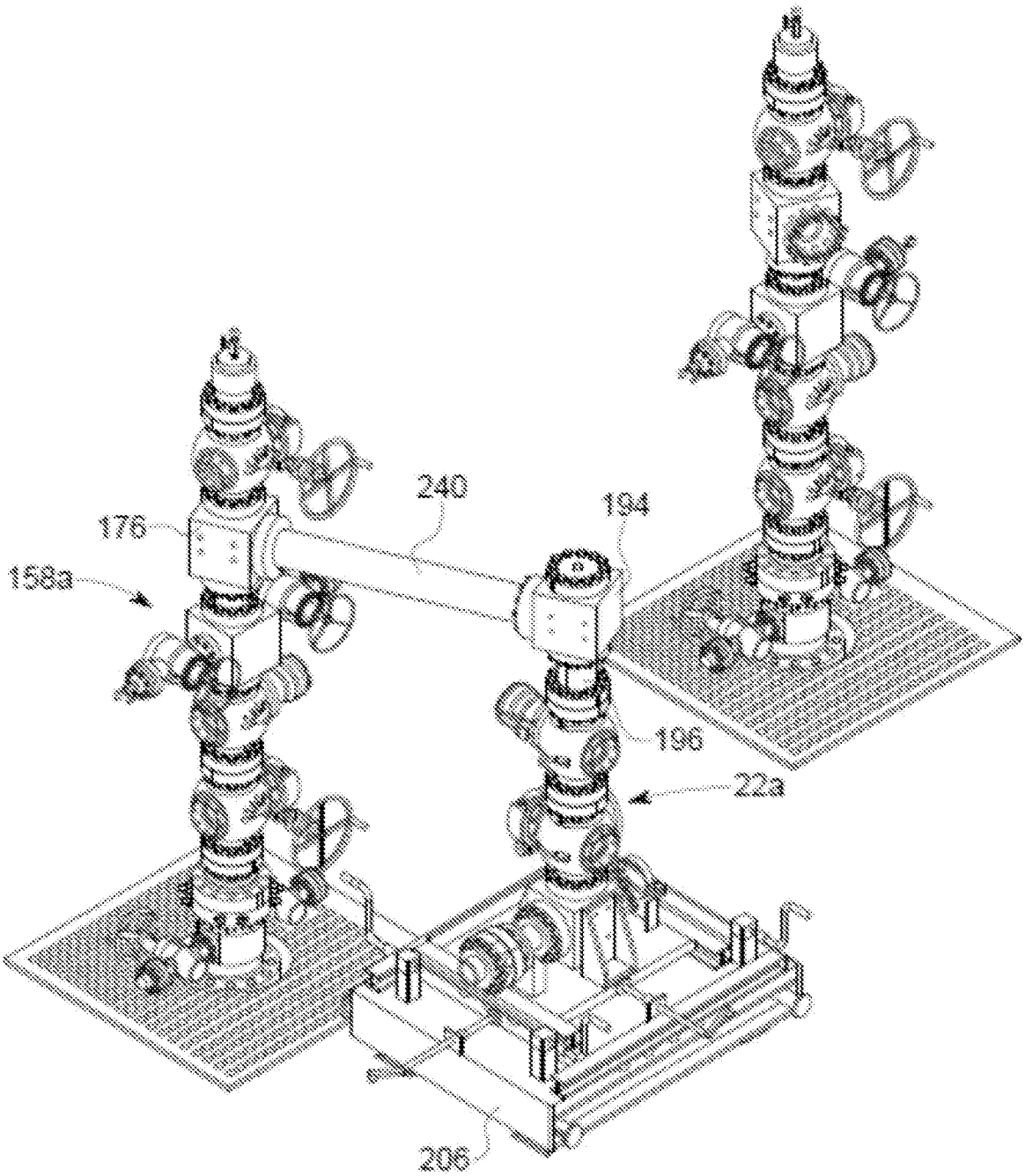

FIG. 12 illustrates a perspective view of a single straight-line connection (pipe 240) between the zipper module 22*a* and frac tree 158*a*. Specifically, the pipe 240 is attached to the swivel tees 176 of the frac tree 158*a* and swivel tee 194 of the zipper module 22*a*, providing a single and straight pathway for frack fluid to flow from the zipper module 22*a* to the frac tree 158*a*. Then, a single straight-line connection, represented in FIG. 12 as pipe 240 with flanged end portions. Once the single straight-line connection (e.g., pipe 240) is in place, frack fluid may be pumped up through the zipper module 22*a*, across the single straight-line connection, and down the frac tree 158*a* to the wellhead 18*a*.

Figure 13:
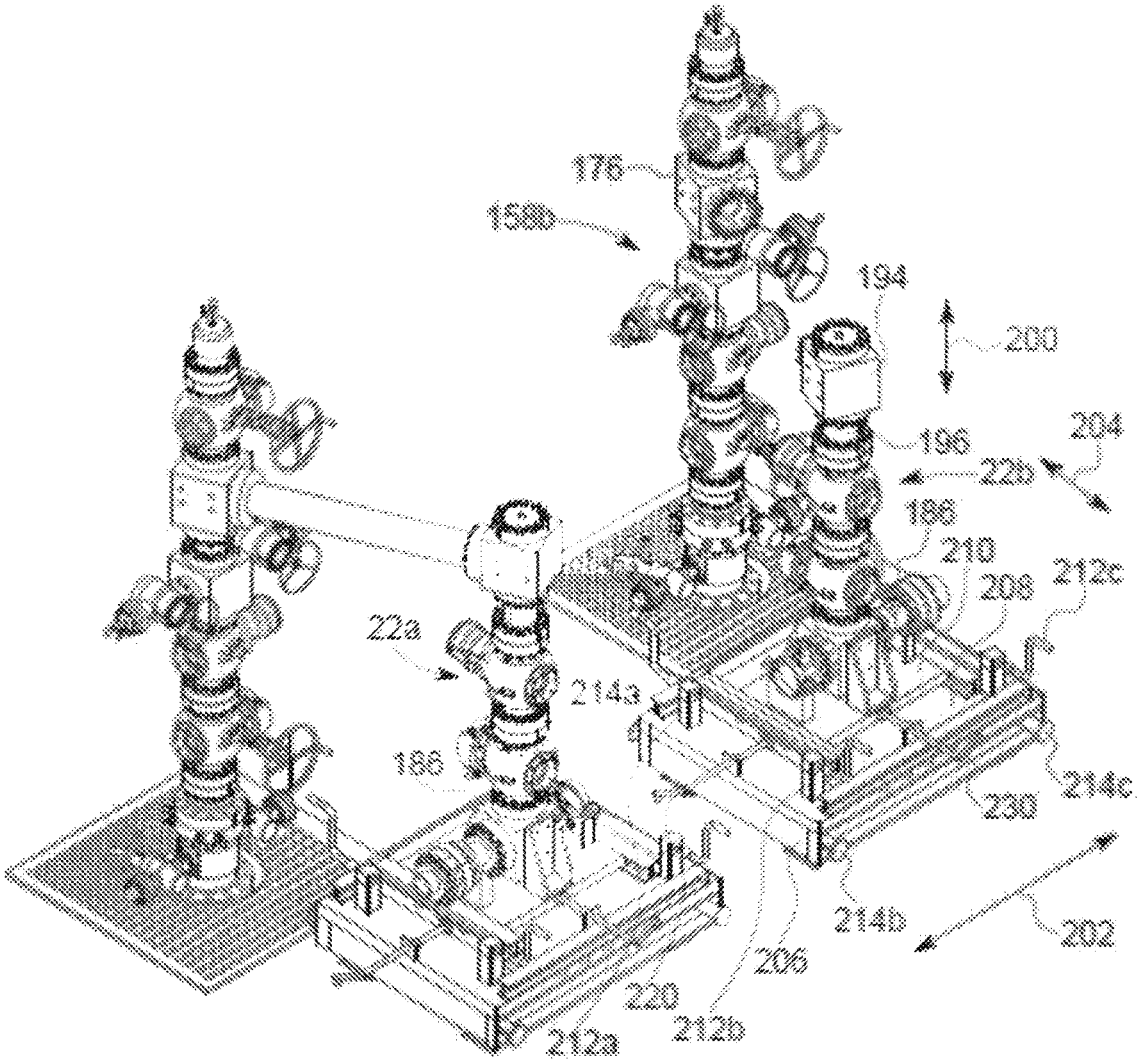

FIG. 13 illustrates a perspective view of two zipper modules 22*a* and 22*b* being connected to frac trees 158*a* and 158*b*, respectively, by way of separate single straight-line connections, shown as pipes 240 and 242. Specifically, the connection tees 186*a* and 186*b* of the zipper modules 22*a* and 22*b*, respectively, are interconnected via straight pipes 240 and 242. Additionally, pipe 244 forms another single straight-line connection between the zipper modules 22*a* and 22*b*. Respective opposing end portions of the pipe 244 are supported by support brackets 238*a* and 238*b*. In some embodiments, the zipper manifold 28 includes only the zipper modules 22*a* and 22*b*. In other embodiments, the zipper manifold 28 further includes the zipper modules 22*c* and 22*d*, which are incorporated into the zipper manifold 28 and operably coupled to the wellheads 18*c* and 18*d*, respectively, in substantially the same manner as described above with respect to the zipper module 22*b* and the wellhead 18*b*.

While FIGS. 12 and 13 represent single straight-line connections as pipes 240, 242, and 240, other embodiments may use any combination of valves (e.g., gate, plug, or the like) and piping connected along a straight path between the zipper modules 22 and the frac trees 158. For example, the pipe 240 may be connected on one end to the swivel tee 194 of the zipper module 22*a* and connected on the other end to one end of a gate or plug valve (not shown), and an opposite end of the gate or plug valve may be connected to the swivel tee 176 of the frac tree 158*a*. In this setup, the pipe 240 and gate or plug valve are connected such that an inner fluid pathway through both spans between the zipper module 22*a* and the frac tree 158*a* along a straight line (e.g., in a single direction and entirely at the same height, as measured from the midpoint of the defined inner fluid channel inside the pipe 240 and gate or plug valve). Thus, only a single connection is made between the zipper modules 22 and the frac trees 158, and that connection traverses along a straight line with a straight height. Also, using the gate or plug valve in the single straight-line connection provides a mechanism for stopping flow through the single straight-line connection, providing another measure of controlling frack or flowback fluid movement.

Attention is now turned to embodiments that depict single straight-line connections between frac trees and flowback equipment. As previously mentioned, well development and extraction operations may use both setups: the embodiments in FIGS. 1-13 for pressure-pumping of frack fluid for fracking, and the embodiments in the FIGS. 14 and 15 for flowback operations.

Figure 14:
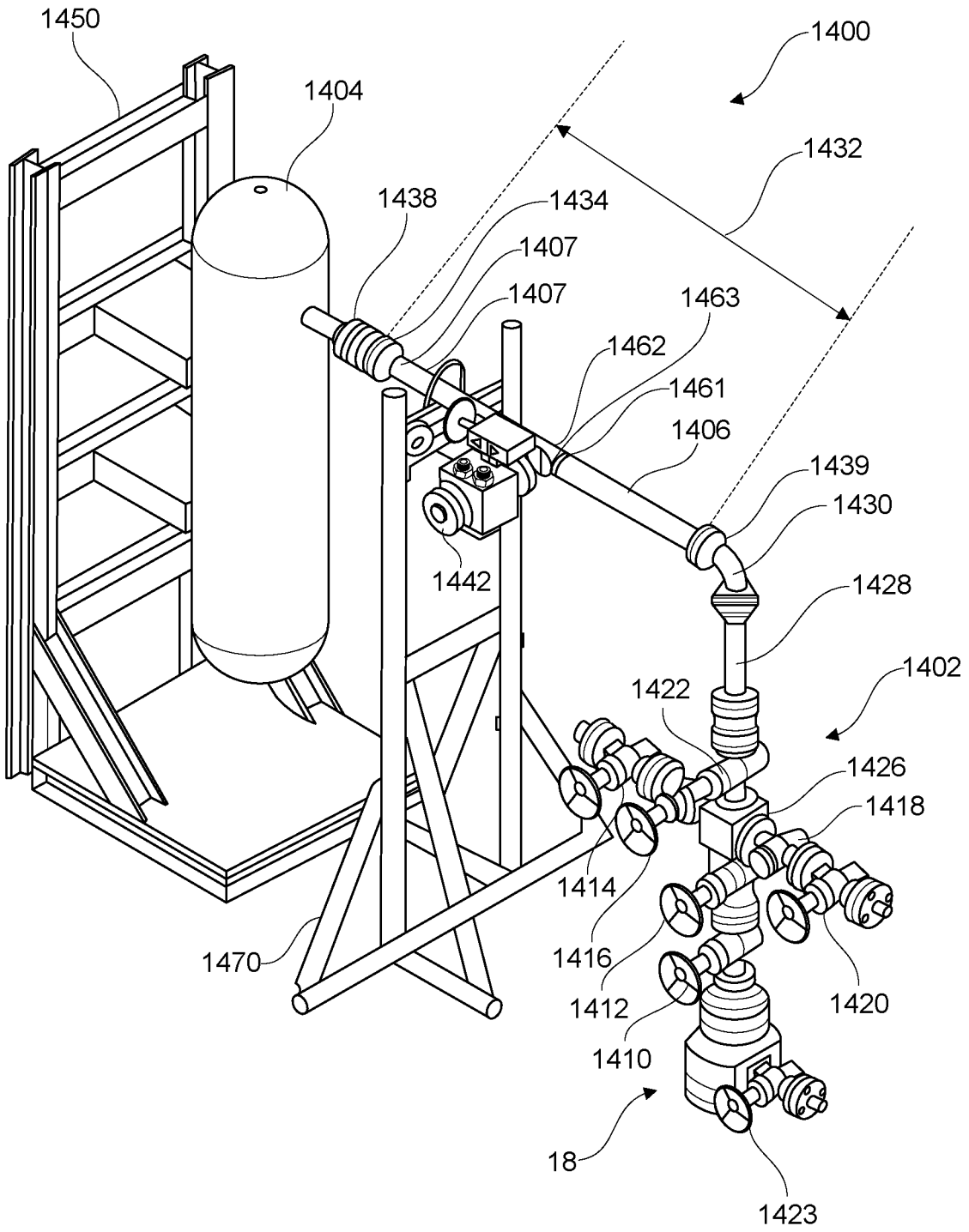
FIG. 14 is a perspective view of a frac tree being connected to a flowback container using a single straight-line connection, according to one example.

FIG. 14 illustrates a perspective view of a flowback setup 1400 using a single straight-line connection 1432, according to one embodiment. The flowback setup 1400 includes a frac tree 1402, which sits atop a wellhead 18, and a flowback container 1404 configured to receive flowback fluid, cuttings, or materials coming up from the wellhead 18. Frac tree 1402 may take the form of any other frac tree 158 described herein instead of the depicted setup. A single straight-line connection 1432 is positioned between the frac tree 1402 and the flowback container 1404 to allow flowback fluid, gasses, and solids out of the wellhead 18 and through the frac tree 1402 to be captured by the flowback container 1404.

The depicted frac tree 1402, which is but one embodiment, includes valves 1410-1424; a centralized tee block 1426; a spool 1428; and an elbow 1430, arranged in the illustrated manner. Other types of frac tree 158 configurations may alternatively be used. Valves 1410-1423 are shown as manually actuated gate valves. Alternative types of valves may be used, such as, for example with limitation, electronically or hydraulically actuated gate valves; manually, electronically, or hydraulically controlled plug valves; or the like.

Flowback container 1404 is a tank for collecting flowback from frac tree 1402. In some embodiments, a scaffolding 1450 is used to hold the flowback container upright, allowing received flowback to enter the flowback container 1404 at or near its top. Other types of flowback containers or equipment may be coupled to the frac tree using the single straight-line connections described herein. In some embodiments, the flowback container 1404 operates as a gas and/or liquid separator, whereby flowback that enters the flowback container 1404 is separated into gas (e.g., natural gas) that rises to the top of the flowback container 1404 and fluid and debris (e.g., frack fluid with cuttings or shale) that is collected in the bottom of the flowback container 1404. Though not shown, corresponding exit terminals or ports may be positioned at or near the top of the flowback container 1404 for separated gas to exit and at or near the bottom of the flowback container 1404 for fluid to exit at or near the bottom. Separated gas and fluid may then be piped to other containers, reservoirs, torches, or other treatment equipment.

The frac tree 1402 in FIG. 13 defines an internal through valves 1410, 1410; tee block 1426; valve 1422; spool 1428 and elbow 1430 for flowback to flow up out of the wellhead 18. One end of elbow 1430 is connected to the spool 1428, and the other end, which is shown as end 1439 and is positioned at a 90-degree angle relative to the end connected to the spool 1428, includes an exit port of the swivel (for the flowback to exit) that is connected to a single straight-line connection 1432. The other end of the single straight-line connection 1432 is connected to end 1438, or inlet port, of the flowback container 1404. The inlet port 1438 of the flowback container 1404 is, in some embodiments, positioned at an upper side of the flowback container 1404, with "upper side" being defined as being in the top third of the flowback container 1404, when oriented vertically as shown in FIG. 14.

Moreover, the flowback container 1404, in some embodiments, has a body that is rounded, or barrel-shaped, to enhance the separation process of flowback captured in the flowback container 1404. In operation, flowback (which may include gas, shale, oil, frack fluid, cuttings, and/or other flowback materials) may be injected—through the inlet port—into the flowback container 1404, and the rounded body may then provide a centrifugal effect on the receive flowback, which in turn enhances the separation of the gas from the liquids and solids in the flowback.

In some embodiments, single straight-line connection 1432 comprises two pipes 1406 and 1407 and a (gate, plug, or other) valve 1442 therebetween. Together, the pipes 1406 and 1407 and valve 1442 define a straight-line fluid channel having an internal midpoint that is the same (or near the same) height between the frac tree 1402 and the flowback container 1404. As shown, flanged end 1440 of the pipe 1406 is connected to end 1439 of the elbow 1430 of the frac tree 1402, and flanged end 1434 of the pipe 1407 is attached to the inlet port, or end 1438, of the flowback container 1404. Respective internal ends 1461 and 1460 of the pipes 1406 and 1407 are connected to gate 1442 at coupling 1463. In operation, flowback flowing up through spool 1428 is angled by elbow 1430 toward and through the single straight-line connection 1432—pipes 1406, gate 1442, and pipe 1407—and into the flowback container 1404.

Alternative embodiments may include additional or alternative piping, gates, or frac iron in the single straight-line connection 1432 to define the channel from the frac tree 158 to the flowback container 1404. For example, only the two pipes 1406 and 1407 may be used, connected together at internal ends 1460 and 1461. Alternatively, the valve 1442 may be positioned between end 1440 of pipe 1406 and end 1438 of elbow 1430, or between end 1434 of pipe 1407 and end 1438 of the flowback container 1404.

Additionally, some embodiments include a support 1470 that buttresses the single straight-line connection 1432. The support 1470 may be take the form of a wooden, metal, plastic, or other type of material used to support the single straight-line connection. Moreover, in some embodiments, the support 1470 may include or be shaped as a ladder enabling servicepeople to reach the single straight-line connection 1432, or specifically the valve 1442 in the single straight-line connection 1432.

The elbow 1430 is shown as having a 90-degree bend. Other embodiments may use different numbers of elbow components combined to together to create a 90-degree angle for flowback to pass through toward the flowback container 1404. For example, two 45-degree elbows or swivels or three 30-degree elbows or swivels may be used. Further still, some embodiments may use various swivels or elbows to create different angles than 90-degrees. Virtually any angle may be created to properly align the single straight-line connection from the wellhead to the flowback container.

Additionally or alternatively, the elbow 1430 may be used as an input for pressure-pumping to frack a well. In this vein, the previously discussed zipper modules in FIGS. 1-13 may be connected to end 1438 to supply frack fluid to the frac tree 1402 using a single straight-line connection (e.g., pipes, valves, and/or other frac iron), as opposed to the embodiment of FIG. 14 where flowback is carried away from the frac tree 1402.

Figure 15:
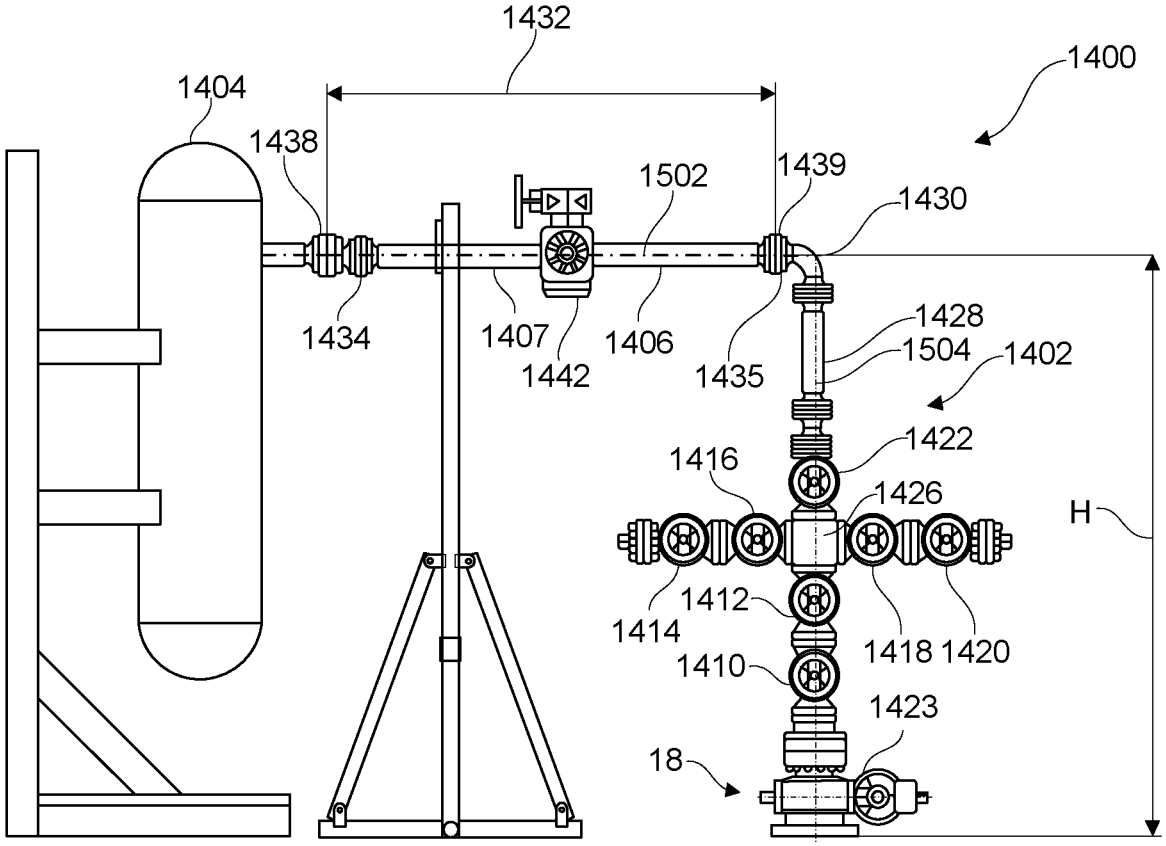
FIG. 15 is a side view of a frac tree being connected to a flowback container using a single straight-line connection, according to one example.

FIG. 15 illustrates a side view of the flowback setup 1400, along with several example measurements (in inches) that provide additional details. Additionally, FIG. 15 shows three axes of flow pathways that are defined within the flowback setup 1400. These illustrated axes show the traversing midpoints of fluid and gas channels defined within the flowback setup 1400.

Specifically, the frac tree defines vertical axis 1502 from wellhead 18 up through gates 1410, 1410; tee block 1426; gate 1422; spool 1428; and part of elbow 1430. Axis 1504 is perpendicular to axis 1502, running through midpoints of gates 1414, 1416, 1418, and 1420. Axis 1506 is defined horizontally, perpendicular to axis 1502, through a part of elbow 1430 and pipe 1406; gate 1442 (e.g., through coupling 1463 shown in FIG. 14); pipe 1407 and end 1436 of the flowback container 1404. In some embodiments, the single straight-line connection 1432 maintains a constant height (H) between the frac tree 1402 and the connected end 1436 of the flowback container 1404. Put another way, the internal channel created by the single-straight-line connection 1432, as well as any others described herein (e.g., pipes 240, 242, and 244 in FIG. 13), do not have any bends or turns off of the depicted horizontal axis 1506.

Moreover, the flowback container 1404 may be placed on a skid that can be raised and lowered in order to better facilitate the single straight-line connections described herein. Alternatively, the flowback container 1404 may be placed on a trailer or the scaffold 1450 or flowback container 1404 itself may be equipped with wheels for mobility.

Additionally or alternatively, any of the disclosed valves shown in the zipper modules, frac trees, large-bore iron fluid lines of the assembly manifolds (including the high- and low-pressure lines/manifolds), or the single straight-line connections may be electronically controlled and/or monitored (e.g., opened or closed) by a local or remote computer, either on the skids, trailers, or manifolds, or from a remote location. In this vein, one more computing devices (e.g., server, laptop, mobile phone, mobile tablet, personal computer, kiosk, or the like) may establish a connection with one or more processors, integrated circuits (ICs), application-specific ICs (ASICs), systems on a chip (SoC), microcontrollers, or other electronic processing logic to open and control the disclosed valves, which in some examples, are actuated through electrical circuitry and/or hydraulics.

Although described in connection with an exemplary computing device, examples of the disclosure are capable of implementation with numerous other general-purpose or special-purpose computing system environments, configurations, or devices. Examples of such computing system environments and/or devices that may be suitable for use with aspects of the disclosure include, but are not limited to, smart phones, mobile tablets, mobile computing devices, personal computers, server computers, hand-held or laptop devices, multiprocessor systems, gaming consoles, microprocessor-based systems, network PCs, minicomputers, mainframe computers, distributed computing environments that include any of the above systems or devices, and the like.

Aspects disclosed herein may be performed using computer-executable instructions, such as program modules, executed by one or more computers or other devices in software, firmware, hardware, or a combination thereof. The computer-executable instructions may be organized into one or more computer-executable components or modules embodied—either physically or virtually—on non-transitory computer-readable media, which include computer-storage memory and/or memory devices. Generally, program modules include, but are not limited to, routines, programs, objects, components, and data structures that perform particular tasks or implement particular abstract data types. Aspects of the disclosure may be implemented with any number and organization of such components or modules. For example, aspects of the disclosure are not limited to the specific computer-executable instructions or the specific components or modules illustrated in the figures and described herein. Other examples of the disclosure may include different computer-executable instructions or components having more or less functionality than illustrated and described herein. In examples involving a general-purpose computer, aspects of the disclosure transform the general-purpose computer into a special-purpose computing device when configured to execute the instructions described herein.

Exemplary computer-readable media include flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware, are non-transitory, and exclude carrier waves and propagated signals. Computer storage media for purposes of this disclosure are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

It is understood that variations may be made in the foregoing without departing from the scope of the disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, or one or more of the procedures may also be performed in different orders, simultaneously or sequentially. In several exemplary embodiments, the steps, processes or procedures may be merged into one or more steps, processes or procedures. In several exemplary embodiments, one or more of the operational steps in each embodiment may be omitted. Moreover, in some instances, some features of the present disclosure may be employed without a corresponding use of the other features. Moreover, one or more of the exemplary embodiments disclosed above, or variations thereof, may be combined in whole or in part with any one or more of the other exemplary embodiments described above, or variations thereof.

Although several "exemplary" embodiments have been disclosed in detail above, "exemplary," as used herein, means an example embodiment, not any sort of preferred embodiment the embodiments disclosed are exemplary only and are not limiting, and those skilled in the art will readily appreciate that many other modifications, changes, and substitutions are possible in the exemplary embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A single straight-line connection between a frac tree coupled to a wellhead and a flowback container, the flowback container comprising a first end at an inlet port, and the frac tree comprising a second end at an outlet port for dispelling flowback, the single straight-line connection comprising:

one or more pipes, wherein at least one end of the one or more pipes is connected to either the first end of the flowback container or the second end of the frac tree;

one or more valves connected to the one or more pipes, wherein the connected one or more valves and the one or more pipes define a straight-line channel for the flowback, the straight-line channel defining a first axis at a constant height between the flowback container and the frac tree.

2. The single straight-line connection of claim 1, wherein the one or more valves are positioned between at least two of the one or more pipes.

3. The single straight-line connection of claim 1, wherein the frac tree defines a second fluid channel for the flowback to flow from the wellhead, the second fluid channel having a second axis that is perpendicular to the first axis of the single straight-line connection.

4. The single straight-line connection of claim 1, wherein the one or more pipes and the one or more valves are connected to form a single conduit between the frac tree and the flowback container, and the single conduit is buttressed by a support between the frac tree and the flowback container.

5. The single straight-line connection of claim 1, further comprising an elbow connected to a top of the frac tree for defining a curved pathway to direct flowback from the frac tree to the straight-line channel.

6. The single straight-line connection of claim 5, wherein the elbow defines the curved pathway from a first end to a second end that faces 90 degrees away from the first end.

7. The single straight-line connection of claim 1, wherein the flowback container is adjustable in a vertical direction to align the flowback container for the single straight-line connection.

8. The single straight-line connection of claim 7, wherein the flowback container is mounted on a skid configured to be raised and lowered to align the first end of the flowback container and the second end of the frac tree.

9. A system for directing flowback from a frac tree coupled to a wellhead to a flowback container, the system comprising:

one or more pipes, valves, or frac iron connected together along a straight line to form a first single straight-line connection between the frac tree and the flowback container, wherein the one or more pipes, valves, or frac iron define a first internal channel for flowback that spans between the frac tree and the flowback container along only a single horizontal axis.

10. The system of claim 9, wherein the defined first internal channel for the flowback spans between the frac tree and the flowback container at a constant height.

11. The system of claim 9, further comprising:

a zipper module connected to one or more manifolds for delivering frack fluid from one or more frac pumps; and a second single straight-line connection connected to the zipper module and the frac tree and defining a second internal channel for the frack fluid to be delivered to the frac tree for supply to the well.

12. The system of claim 9, wherein the flowback container comprises an inlet port positioned on an upper side of the flowback container and a rounded body.

13. The system of claim 9, wherein the flowback container is adjustable in a vertical direction to align the flowback container for the single straight-line connection.

14. The system of claim 13, wherein the flowback container is mounted on a skid configured to be raised and lowered to align a first end of the flowback container and a second end of the frac tree.

15. A flowback system for capturing flowback from a well affixed with a frac tree, the frac tree defining a vertical internal channel for the flowback exiting the well and having an exit port for directing the well along a horizontal axis perpendicular to the vertical internal channel, the flowback system comprising:

a flowback container with an inlet port; and a single straight-line connection configured to be connected to the inlet port of the flowback container and the exit port of the frac tree, the single straight-line connection comprises a connected arrangement of one or more pipes and at least one valve that together define a straight internal channel from the exit port of the frac tree to the inlet port of the flowback container for the flowback to be communicated to the flowback container.

16. The flowback system of claim 15, wherein the one or more pipes comprise at least two pipes that are separated and connected to the at least one valve.

17. The flowback system of claim 15, wherein the single straight-line connection defines the straight internal channel to have a constant height from the frac tree to the flowback container.

18. The flowback system of claim 15, wherein the single straight-line connection has no bends or turns between the frac tree and the flowback container.

19. The flowback system of claim 15, wherein the flowback container is adjustable in a vertical direction to align the flowback container for the single straight-line connection.

20. The flowback system of claim 19, wherein the flowback container is mounted on a skid configured to be raised and lowered to align the inlet port of the flowback container and the exit port of the frac tree.

* * * * *